United States Patent [19]

Eisinger

[11] Patent Number: 5,039,021

[45] Date of Patent: Aug. 13, 1991

[54] PULVERIZING MILL HAVING EXTERNAL LOADING ARM MEHCANISM

[75] Inventor: Frantisek L. Eisinger, Bergen, N.J.

[73] Assignee: Foster Wheeler Energy Corporation, Clinton, N.J.

[21] Appl. No.: 513,418

[22] Filed: Apr. 23, 1990

[51] Int. Cl.[5] ..... B02C 15/00

[52] U.S. Cl. ..... 241/121

[58] Field of Search ..... 241/117–121, 241/287–289

[56] References Cited

U.S. PATENT DOCUMENTS 4,235,385 11/1980 Brundiek ..... 241/121 X 4,909,450 3/1990 Henne et al. ..... 241/121 X

FOREIGN PATENT DOCUMENTS 452020 10/1948 Canada ..... 241/121

315781 7/1929 United Kingdom ..... 241/121

*Primary Examiner*—Mark Rosenbaum

*Attorney, Agent, or Firm*—Marvin A. Naigur

[57] ABSTRACT

A pulverizing mill for particulate material such as coal, containing a plurality of roller units each pivotably attached to the mill casing. The roller units are each biased downwardly against a rotatable table and annular track by dual loading arms which are pressed downwardly by spring means located outside the casing. The spring means are provided either by coil type springs contacting the loading arms, or are provided by the loading arms being fixed at their outer ends to the casing so as to act as curved torsional spring arms to provide a downwardly force on the roller units. The roller unit pivot shaft is advantageously attached to the casing at a level below the roller axis.

6 Claims, 6 Drawing Sheets

28
69
66
66
C
C
10
67
B
B
67
12a
A
A
2
2
68
68
12
30
31
34
36
64
33
38
37
63
39
23
22
60
21
12b
19
62
14
20
16
16
24
18
18

PULVERIZING MILL HAVING EXTERNAL LOADING ARM MEHCANISM

BACKGROUND OF INVENTION

This invention pertains to a pulverizing mill for particulate materials such as coal, in which the mill rollers are each loaded by loading arms and spring units located external to the mill casing.

Pulverizing mills for coal are well known and the prior art has provided many designs of pulverizing mills using multiple rollers which are pivotally mounted from the mill casing or wall and are spring-loaded so as to press downwardly onto the material such as coal being pulverized. Most such pulverizing mills utilize roller loading arrangements located within the mill casing. However, some recent pulverizer designs have roller loading means located at least partly outside the pulverizer casing. For example, U.S. Pat. No. 4,072,276 to Romanowski; U.S. Pat. No. 4,538,768 to Paskowski et al; U.S. Pat. No. 4,717,082 to Guido et al; U.S. Pat. No. 4,706,900 to Prairie et al; and U.S. Pat. No. 4,759,509 to Prairie disclose pulverizing mills such as for coal, which utilize multiple rollers spring-loaded by coil type springs which are adjustable from outside the pulverizer casing. However, these prior art designs have the disadvantage that the loading arm and spring elements are located within the mill casing where they are exposed to abrasive particles which cause wear. These abrasion problems have now been advantageously overcome by the present invention.

SUMMARY OF INVENTION

This invention provides a pulverizer mill adapted for pulverizing particulate solids such as coal, which mill includes a vertically-oriented casing containing a rotatable table having an annular track provided near the table periphery. At least one roller unit is pivotably attached to the casing and bears on the table annular track. Each roller unit is loaded by a loading means which is located external to the mill casing. The roller loading means includes dual external loading arms and spring assemblies which are arranged to exert a torsional load or moment transmitted through a hub and pivot bracket onto the rollers. The applied torsional load transmits a downward force through the pivot bracket to the roller units, and provides the loading force needed for crushing and pulverizing the particulate solids supplied onto the annular track of the pulverizer mill through a central supply conduit.

The principal components of the roller unit loading mechanism for one embodiment of the invention include a roller axle and pivot bracket with integral hub containing the roller axle, a pivot shaft and hub pivotably attached to the casing, dual loading arms rigidly attached to the pivot hub, and spring means which press or bias downwardly on each loading arm. The pivot bracket for the roller units is attached to the mill casing by a shaft and hub, which are positioned at a level below the roller unit axis. Such location minimizes the horizontal (lateral) motion of the roller unit at the roller-to-table contact point, thereby minimizing the lateral dynamic forces acting upon the rollers.

The location of the spring means exerting a downward force upon the loading arms is such that the spring forces are transmitted to the roller units through the torsional action of the loading arms, and only small forces are transmitted to the pivot shaft bearings. This arrangement has the advantage of providing long life for the shaft bearings, as well as reducing the need for special reinforcement of the casing. The entire loading mechanism for the roller units is advantageously located outside the mill casing, and thus is easily accessible for inspections and maintenance.

In an alternative configuration or embodiment of the invention, the pivotable roller units are each loaded by dual torsional arm spring members. The roller units are pressed downwardly by torsional spring arm members instead of helical spring units. Two torsional spring arms per roller unit are used, and the arms are fixed at their outer ends to the mill casing. A torsional load is transmitted through the pivot shaft hub and pivot bracket to the rollers, with the downward force acting upon each of the rollers. A local stiffening of the mill casing is provided as needed at the torsional spring hub attachment points.

The pulverized coal is air entrained from the tubular annular track upwardly through a centrifugal separation arrangement and exits at the pulverizer upper end. In comparison with some existing designs of pulverizer mills, the present design provides the advantage of having no roller loading parts being located inside the mill casing where exposure to the pulverized coal would detrimentally affect mill performance. Because of its simplicity, the mill design configuration should be very cost efficient.

BRIEF DESCRIPTION OF DRAWINGS

This invention will be described with the aid of the following drawings, in which.

DESCRIPTION OF INVENTION

Figure 1:
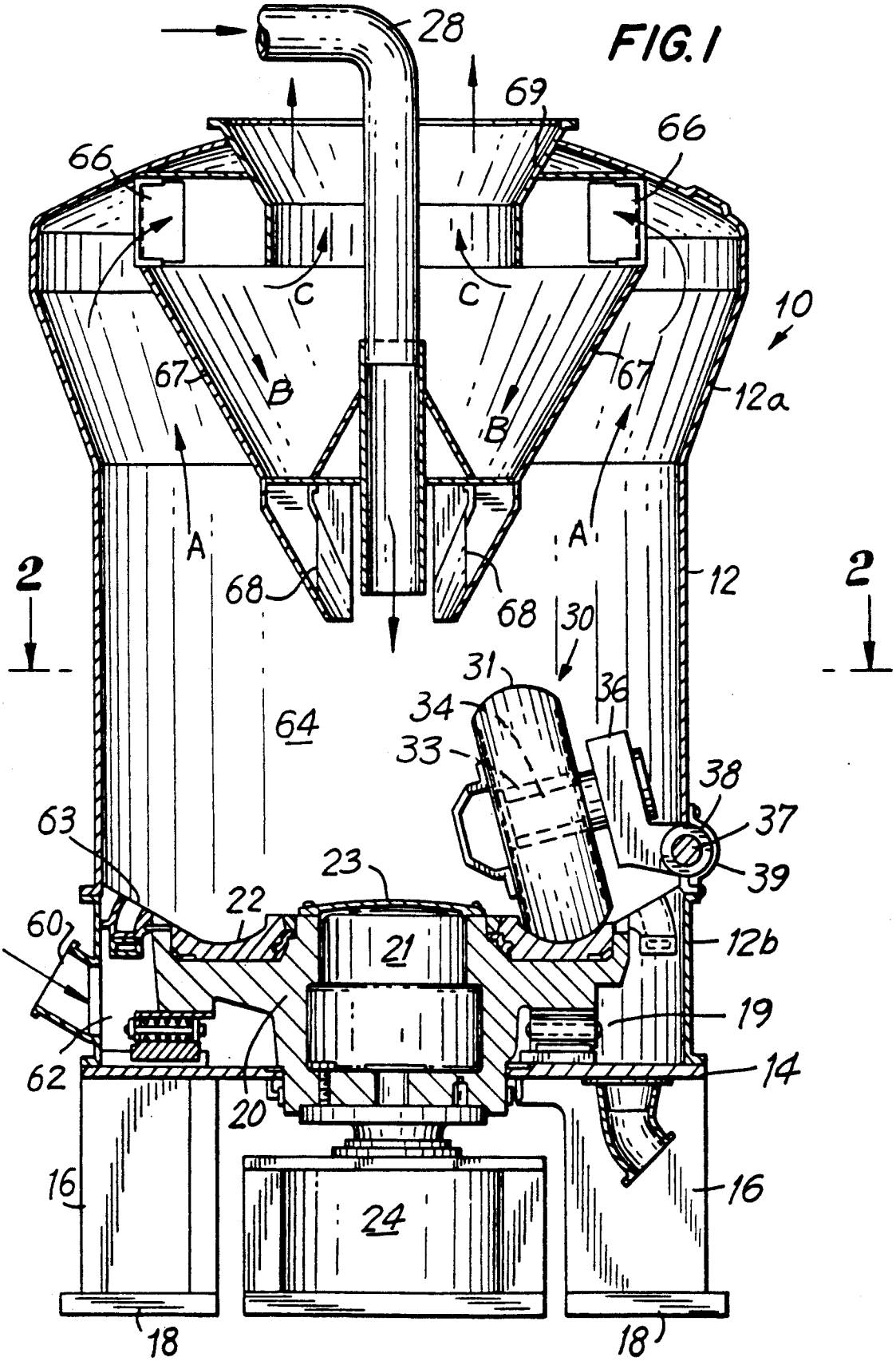
FIG. 1 shows a general elevation sectional view of a pulverizer mill having internal roller units which are each loaded by external arms and spring means according to the invention.

As shown by FIG. 1, a coal pulverizing mill generally indicated at 10 has an outer casing or shell 12, which includes an upper portion **12*a* joined to a lower portion 12*b*. The casing lower portion 12*b* is mounted on a base plate 14, which in turn is supported on legs 16 which extend upwardly from a footing 18. Located within the lower portion of casing 12 is a circular rotatable table 20, which is supported from base plate 14 by bearings 19 and is mounted such as by bolts on a drive motor unit 24 provided directly below the table 20**.

The rotatable table 20 has a hollow central portion 21 and includes an annular-shaped track 22 located near the table outer periphery. The annular track 22 is concave in cross section and made of wear resistant material such as hardened steel. A cover 23 bridges the hollow central portion 21 of table 20 to prevent particulate material from entering the central portion above the drive motor 24. The annular track 22 and cover 23 are secured to the rotary table 20 by bolts, so that the track and cover are rotated together with the table 20 by the drive motor 24.

Unpulverized coal is introduced into the mill casing 12 through a central upper conduit 28, which extends down through the upper portion 12*a* of the mill casing to a location above the center of the rotary table 20. The coal from conduit 28 falls onto the table 20, and is moved radially outwardly by centrifugal forces to the annular track 22. The coal passes between the track 22 and multiple roller units 30, which are pivotably attached to casing 12*a* so as to bear down on the coal in the track 22. Although the pulverizer mill 10 employs at least two roller units 30, only one is shown in FIG. 1 for simplicity.

Each roller unit 30 includes an outer tread portion 31, which is convex curved in cross section so that it has the shape of the outer portion of a torus. The tread portion 31 is made of hardened metal and is secured to an inner wheel portion 32 positioned within the tread portion. Each roller unit 30 has bearings 33 and rotates about an axle 34. The axle 34 includes a journal portion 35 which forms the inner race for the bearings 33, and has an increased diameter portion positioned between the journal portion 35 and an enlarged pivot bracket 36. The axle 34 preferably includes a narrow annular space which is supplied with seal air at sufficient pressure so that air will continually flow out through the annular space and thereby prevent coal dust from entering and damaging the bearings 33.

The roller support pivotable bracket 36 is centrally and rigidly mounted on an elongated shaft 37, which is rotatably retained near each of its ends by a concentric sleeve bearing 38. The sleeve bearings 38 are enclosed by a hub 39, which is removably attached to the pulverizer casing 12. Attached rigidly to each end 40 of elongated shaft 37 are dual external loading arms 41 and 42, respectively, as are better shown by FIG. 2. The pivotable roller support bracket 36 and the attached roller unit 30 are biased downwardly against the table annular track 22 by the dual external loading arms 41 and 42, which are each rigidly attached at its inner end to an end 40 of shaft 37, and are each spring loaded at its outer end by spring units 43 and 44, respectively, which are mounted on the outside of casing 12.

Figure 2:
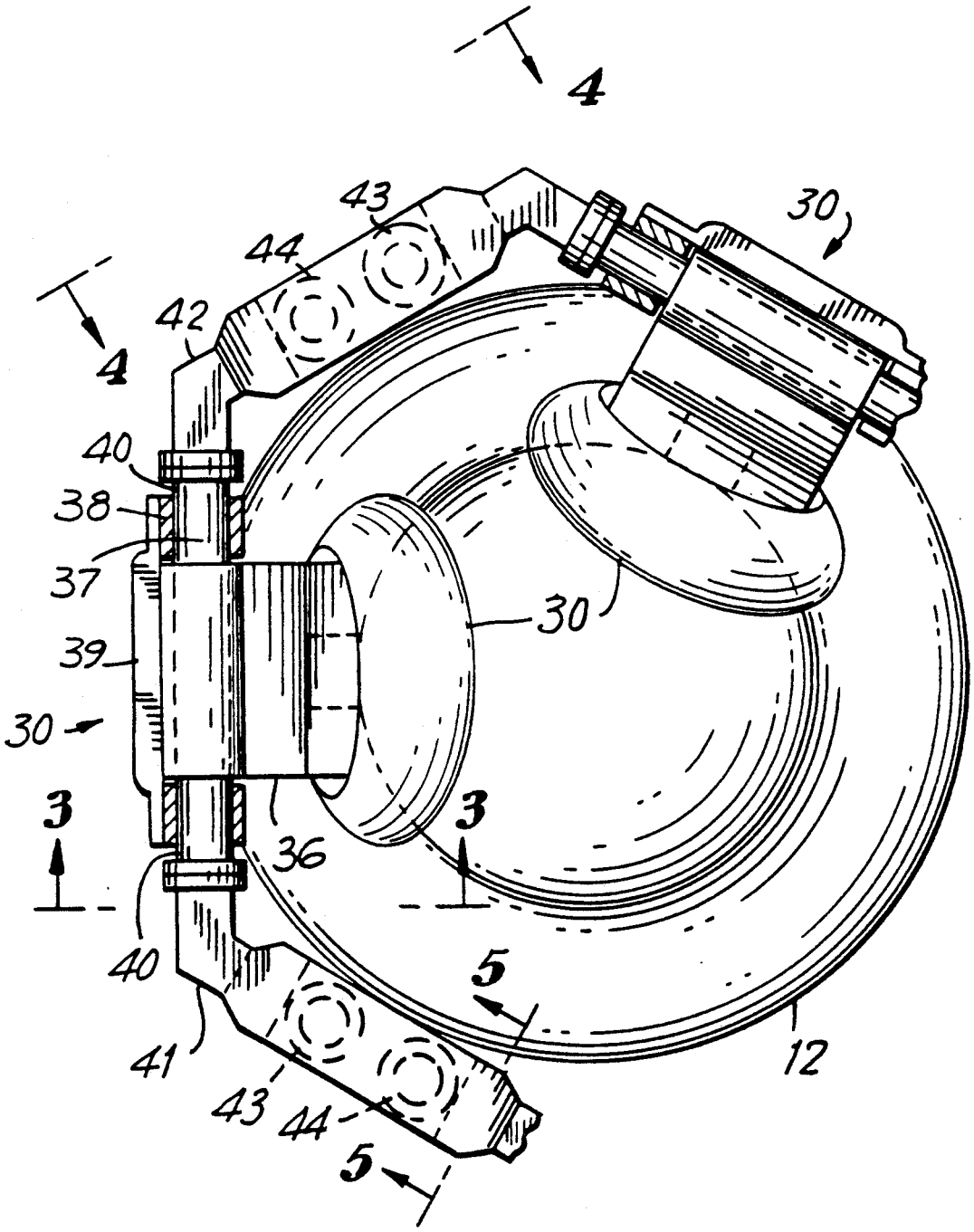
FIG. 2 shows a plan sectional view of a pulverizer mill taken at line 2—2 of FIG. 1, and in which each roller is loaded by two external arms and coil type springs.
Figure 3:
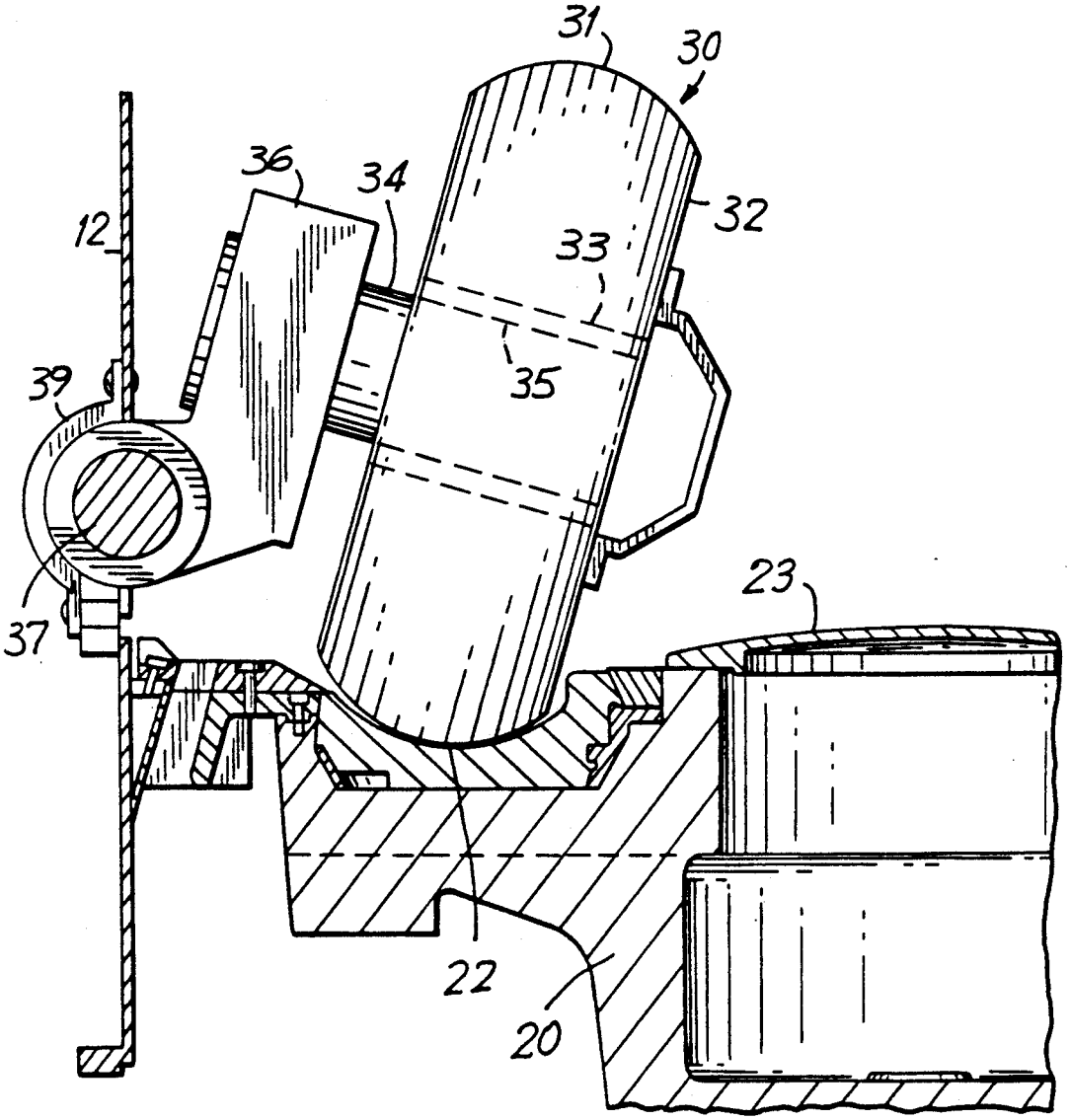
FIG. 3 shows an elevation sectional view of a roller assembly taken at line 3—3 of FIG. 2.

As shown by FIG. 2, two roller units 30 provided within the casing 12 are each pivotably attached by shaft 37 and hub 39 to the casing wall 12. An enlarged view of the pivotable roller unit 30 is additionally shown by FIG. 3, which shows that shaft 37 and hub 39 are located below the roller bearing 33. As seen in FIG. 2, each roller unit 30 has two external loading arms 41 and 42, which extend along the casing 12 from each end 40 of the pivot shaft 37. Each loading arm and the attached roller unit 30 is biased downwardly by the coil springs 43 and 44 which each contact the outer end of external loading arms 41 and 42 respectively, as is shown in greater detail by FIG. 4.

Figure 4:
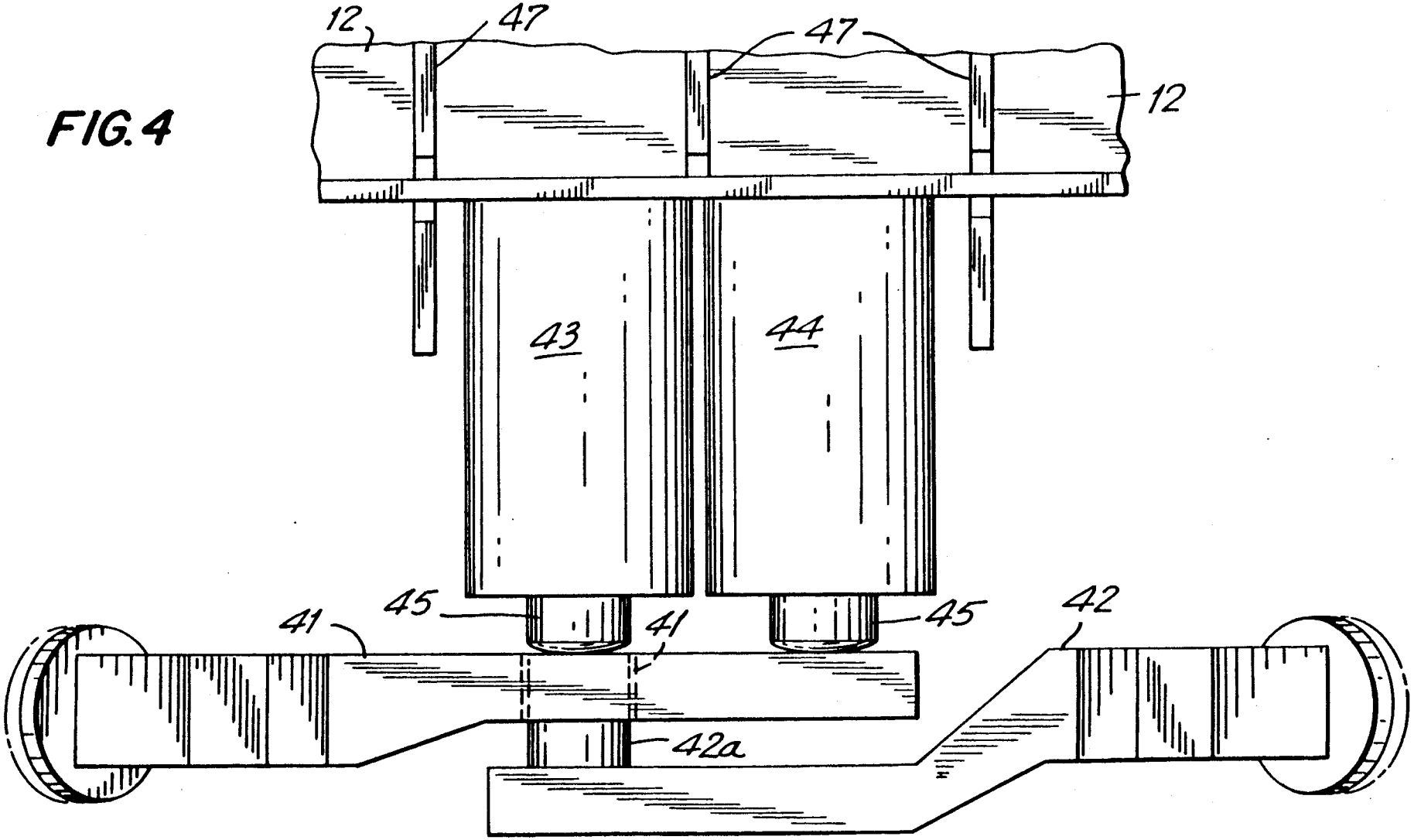
FIG. 4 shows an elevation view of the external loading arms and coil spring assembly for each roller taken at line 4—4 of FIG. 2.

As seen in FIG. 4, the adjacent loading arm outer portions for each roller unit 30 are provided in a superposed position relative to each other. The coil springs 43 and 44 are mounted adjacent each other and parallel with the casing 12 on which they are mounted, and are arranged so that a spring plunger 45 presses downwardly on the outer or terminal end of each loading arm 41 and 42. The lower loading arm 42 has a vertical extension portion 42*a* which extends upwardly through an opening 41*a* in upper arm 41, and contacts the lower end of coil spring unit plunger 45. This coil spring arrangement is shown in greater detail in elevational sectional view FIG. 5, including casing ring member 46 and stiffening rib members 47 which are arranged for attaching the coil springs 42, 43 onto the casing 12.

Figure 5:
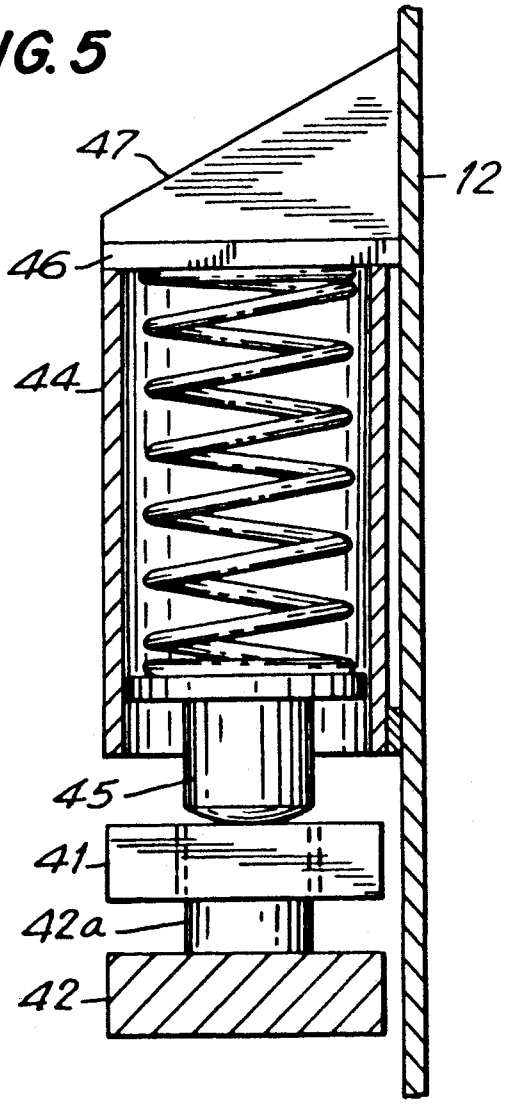
FIG. 5 shows an elevation sectional view of a coil spring unit taken at line 5—5 of FIG. 2.

Alternatively, the loading arms 41 and 42 can be oriented in a side-by-side arrangement (not shown) instead of a superposed arm arrangement as shown by FIGS. 4 and 5.

Figure 7:
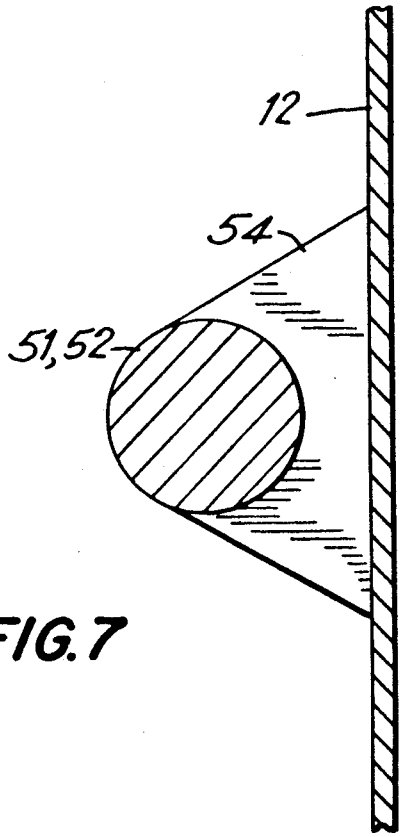
FIG. 7 shows an elevation view of the torsional spring arm attachment to the mill casing taken at line 7—7 of FIG. 6.
Figure 6:
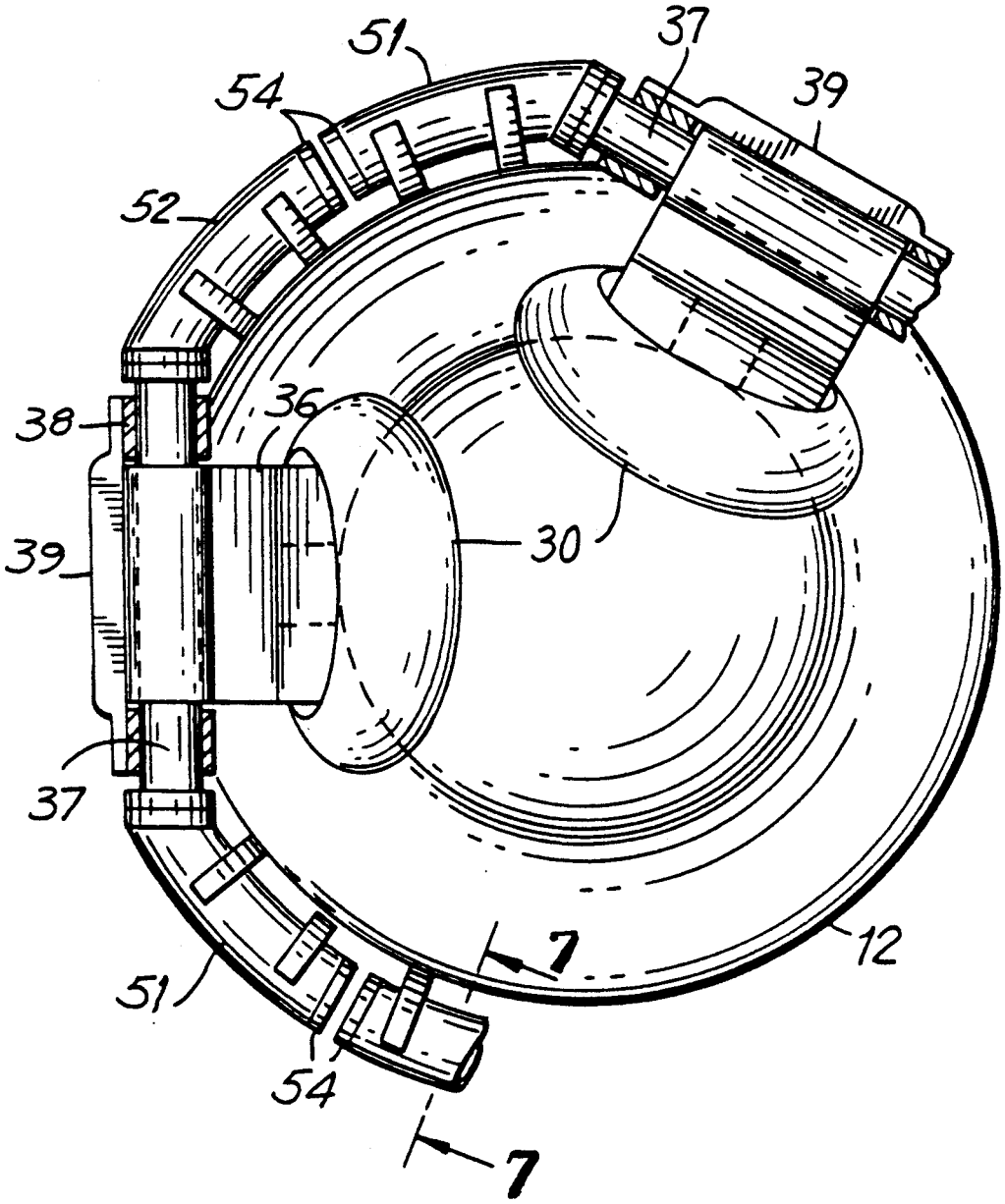
FIG. 6 shows a plan sectional view of an alternative embodiment of a pulverizer mill, in which the rollers are each loaded by dual elongated torsion type spring arms.

In an alternative embodiment of this invention as shown in plan view by FIG. 6, the coil spring units 43, 44 can be replaced by utilizing the two loading arms 41 and 42 as dual torsion type spring members 51, 52, which are provided for biasing each roller unit 30 downwardly against table track 22. In this embodiment, the two torsion springs 51, 52 are rigidly attached at their inner ends to each end of the pivot shaft 37 as before, and the arms are attached at their outer ends to the outer side of casing 12 at brackets 54, as generally shown by FIG. 7. The torsional spring arms 51, 52 act to force downwardly the roller units 30 against the coal being pulverized in track 22 of rotatable table 20.

During operation of the pulverizing mill 10, raw coal drops down the central conduit 28 onto the table cover 23, and moves radially outwardly due to centrifugal forces exerted by the rotating table 20 to annular track 22. The coal passes into the annular track 22 and is pulverized by the loaded rollers 30, which each rotate over the coal within the track. The shape of the tread portion 31 of each roller unit 30 and the concave shape of the track 22 tends to temporarily confine coal between the roller tread 31 and the track, so that the coal particles are exposed to pressure sufficient to crush and pulverize the coal.

The pulverized coal is blown upwardly by an air supply which is introduced through conduit 60 into annular air chamber 62 provided beneath table 20, and then passes up through air ports 63 located adjacent the table track 22 into the space 64 within the casing 12. The flowing air carries the pulverized coal from table 20 upwardly in the direction of arrows "A" to pass through a series of horizontal vanes 66 which impart rotation to the mixture of air and coal particles around the vertical axis of the coal pulverizing mill 10. This arrangement acts as a centrifugal separator, so that the coarse heavier particles are thrown outwardly and drop down into a housing 67 in the direction of the arrows "B". These coarse particles drop through hinged doors 68 which move inwardly under the weight of the coarse particles. The doors 68 act to prevent the entrained pulverized coal moving upward in the direction of the arrows "A" from passing into the housing 67.

The remaining entrained fine coal particles are carried radially inwardly in the direction of the arrows "C" and pass upwardly through a central passage 69, which conveys the air-coal mixture to its further use, such as a coal fired steam generator (not shown).

This invention will be further described by the following Example, which should not be construed as being limiting in scope.

EXAMPLE 1

A coal pulverizer mill is provided which includes a vertically-oriented casing which has a rotatable table containing an annular track provided in its lower portion. Three roller units are pivotably attached to the casing above the table and rest on the table annular track. The roller units each have two elongated loading arms located outside the casing and attached to the roller units, so that the arms each are forced downwardly by a coil spring mounted on the casing outer side. Raw coal is introduced from the casing upper end onto the rotary table, and is pulverized by action of the spring-loaded roller units being pressed against the table track. The resulting pulverized coal is air entrained upwardly and is discharged at the casing upper end to a coal combustion unit.

Although this invention has been described broadly and in terms of two embodiments, it will be understood that modifications and variation can be made within the scope as defined by the following claims.

I claim:

1. A rotary pulverizing mill, comprising:

a vertically-oriented casing, including means for introducing particulate material into and removing it from the casing;

a table rotatably mounted within a lower portion of said casing, said table having an annular-shaped track for receiving particulate material to be pulverized;

a plurality of roller units each located above said table and being pivotably attached to said casing by pivot means, each said roller unit having an outer tread portion bearing downwardly on the annular-shaped track of said table;

dual loading arms located outside said casing, with each arm having an inner end which is rigidly attached to an end of said pivot means for each said roller unit; and spring means located outside said casing and arranged to bias downwardly each said roller unit, whereby particulate material placed on the table annular track can be crushed and pulverized by the spring-loaded roller units and removed from the casing.

2. A pulverizing mill according to claim 1, wherein said spring means include coil type springs which are mounted to said casing above each said loading arm, so as to press downwardly on an outer end of each said arm.

3. A pulverizing mill according to claim 1, wherein said dual loading arms each have an outer end which is fixed onto said casing between said pivot means, so that said spring means is provided by each arm applying a downward torsional spring load on each said roller unit.

4. A pulverizing mill according to claim 1, wherein the roller unit pivot means is located below the roller axis, so as to minimize horizontal movement of the roller on the table annular track.

5. A rotary pulverizing mill for particulate material, comprising:

a vertically-oriented casing, including means for introducing particulate material into and removing the pulverized material from the casing;

a table rotatably mounted within a lower portion of said casing, said table having an annular-shaped track for receiving particulate material to be pulverized;

a plurality of roller units each located above said table and pivotably attached to said casing by pivot means, each said roller unit having an outer tread portion bearing downwardly on the annular-shaped track of said table, and having the pivot means located at a level below the roller axis;

dual loading arms located outside said casing, with each arm being rigidly attached at its inner end to an end of said pivot means for each said roller unit; and a coil spring unit mounted outside said casing and arranged to press downwardly on the outer end of each said loading arm, whereby particulate material placed on the table annular track can be crushed and pulverized by said spring-loaded roller units and then removed from the casing.

6. A rotary pulverizing mill for particulate material, comprising:

a vertically-oriented casing, including means for introducing particulate material into the casing and removing the pulverized materials therefrom;

a table rotatably mounted within a lower portion of said casing, said table having an annular-shaped track for receiving particulate material to be pulverized;

a plurality of roller units each located above said table and pivotably attached to said casing by a pivot means, each said roller unit having an outer tread portion bearing downwardly on the annular-shaped track of said table;

dual loading arms located outside said casing, each said arm being rigidly attached at its inner end to an end of said pivot means for each said roller unit, and fixed at its outer end to said casing intermediate said pivot means, said dual loading arms being arranged to apply a downward torsional spring load force to each roller unit, whereby particulate material placed on the table annular track can be crushed and pulverized by the spring-loaded roller units and then removed from the casing.

* * * * *